US007727052B2

(12) United States Patent
Borucki

(10) Patent No.: US 7,727,052 B2
(45) Date of Patent: Jun. 1, 2010

(54) REMOVABLE POLISHING PAD FOR CHEMICAL MECHANICAL POLISHING

(75) Inventor: Leonard J. Borucki, Mesa, AZ (US)

(73) Assignee: Araca Incorporated, Tucson, AZ (US)

( * ) Notice: Subject to any disclaimer, the term of this patent is extended or adjusted under 35 U.S.C. 154(b) by 0 days.

(21) Appl. No.: 11/937,792

(22) Filed: Nov. 9, 2007

(65) Prior Publication Data

US 2009/0124176 A1 May 14, 2009

(51) Int. Cl.
*B24B 1/00* (2006.01)

(52) U.S. Cl. ..... 451/41; 451/285

(58) Field of Classification Search ..... 451/41, 451/285–290

See application file for complete search history.

(56) References Cited

U.S. PATENT DOCUMENTS 2,991,596 A * 7/1961 Walters ..... 451/508
3,243,833 A * 4/1966 Hencken ..... 451/490
4,322,920 A * 4/1982 Wells ..... 451/342
4,527,358 A * 7/1985 Day ..... 451/287
5,584,750 A * 12/1996 Ishida et al. ..... 451/288
5,628,679 A * 5/1997 Shiga ..... 451/508
6,086,464 A * 7/2000 Ulfig et al. ..... 451/259
6,151,792 A * 11/2000 Ohlig et al. ..... 33/613
6,244,941 B1 * 6/2001 Bowman et al. ..... 451/287
6,835,118 B2 * 12/2004 Berkstresser et al. ..... 451/28
7,118,465 B2 * 10/2006 Kim ..... 451/290
7,156,722 B2 * 1/2007 Min et al. ..... 451/41
7,217,177 B2 * 5/2007 Frech et al. ..... 451/359
2003/0114079 A1 * 6/2003 Berkstresser et al. ..... 451/28

* cited by examiner

*Primary Examiner*—Maurina Rachuba
(74) *Attorney, Agent, or Firm*—Sughrue Mion, PLLC

(57) ABSTRACT

The present invention offers a device for rendering CMP polishing pads easily and temporarily removable from and replaceable upon the platen of a CMP polishing apparatus comprising two sheets, the upper sheet attached to the said CMP polishing pad and the lower attached to the said platen, the said two sheets held together by pegs, pins or protrusions fitted to matching holes in the upper surface of the lower sheet and the lower surface of the upper sheet, said pegs or pins attached to either the upper or lower sheet and able to enter the hold on the adjoining sheet when the sheets are brought together and hold the sheets together by means of the sliding friction attendant upon a tight fit with the said holes. The device allows far easier metrology and storage of CMP polishing pads at different stages of use with no damage to the CMP pad, which may be put back into service at any time. The transparency of the upper sheet further allows users to prevent formation of bubbles in the adhesive holding the CMP pad to the upper sheet, thereby avoiding significant degradation of CMP performance.

23 Claims, 4 Drawing Sheets

Drawing 1
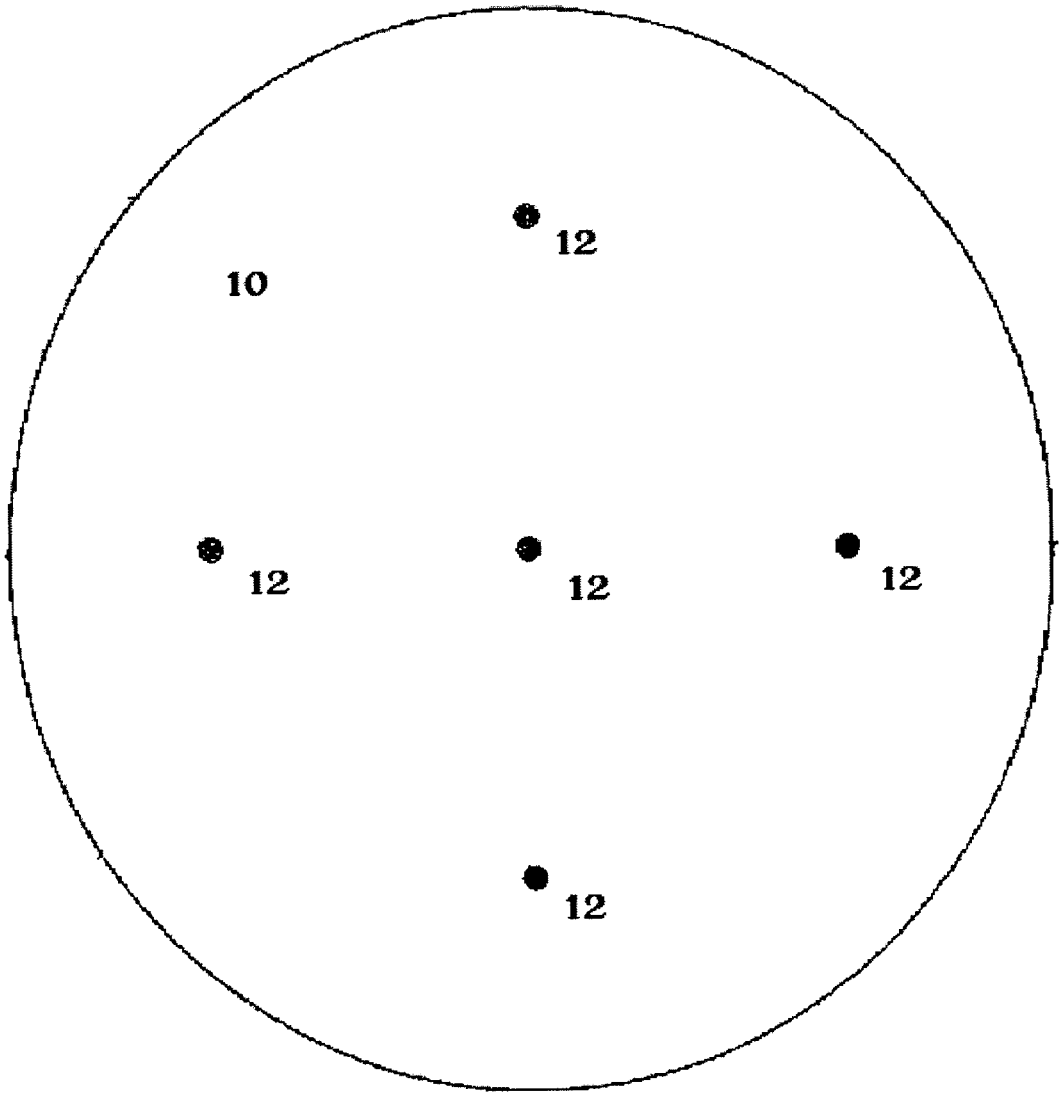

Drawing 2
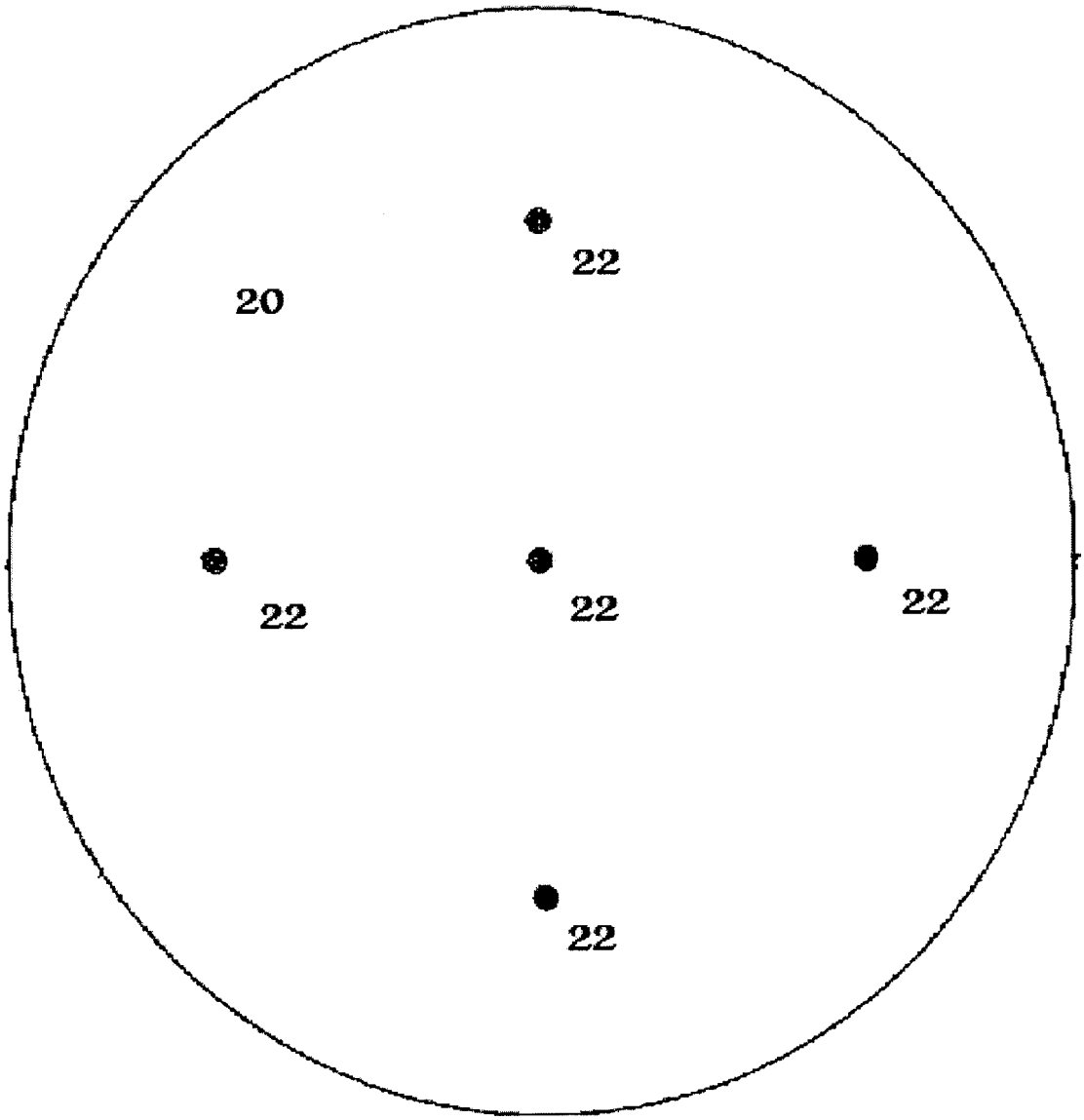

Drawing 3
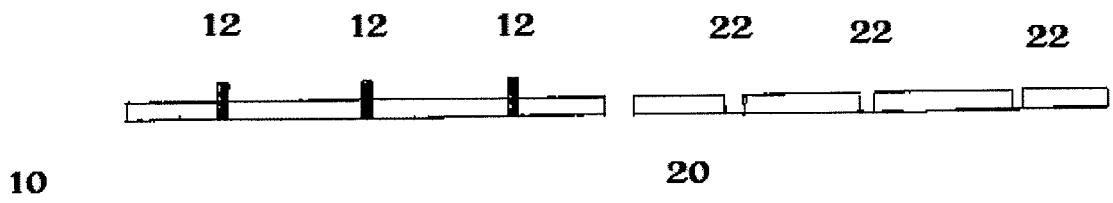

Drawing 4
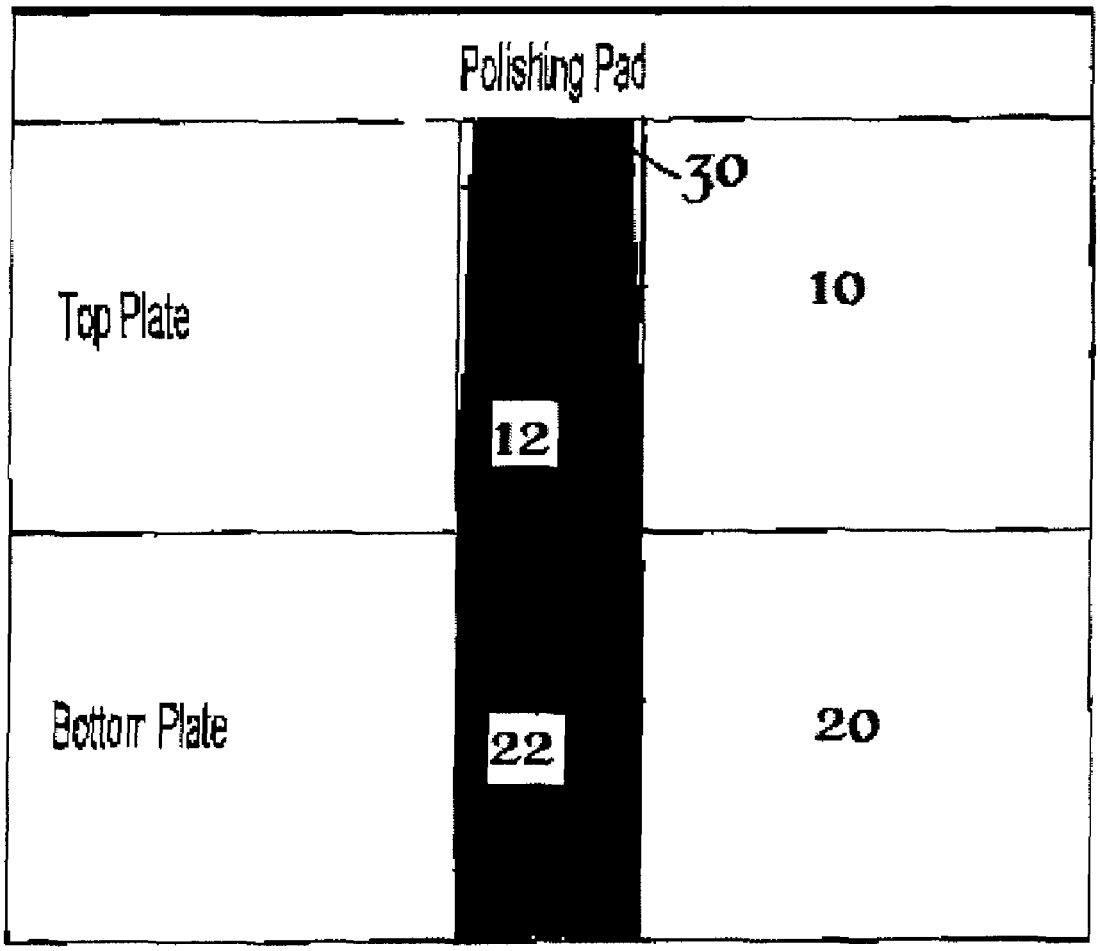

REMOVABLE POLISHING PAD FOR CHEMICAL MECHANICAL POLISHING

BACKGROUND OF THE INVENTION (1) Field of the Invention

The present invention relates to a removable CMP polishing pad, devices using the same and a method for chemical mechanical polishing.

(2) Description of Related Art

Polishing Pads together with slurry and diamond conditioner disks form the key components of the equipment used to carry out CMP processes in recent years. These pads have been produced and marketed by several vendors to standards of reliable quality and effectiveness. The function of the polishing pad is to provide the base upon which the mechanical action of the slurry on the wafers may be carried out by limiting the space between the pad and the wafer and thereby forcing the abrasive components of the slurry into contact with the wafer surface in a manner that renders regular and suitable mechanical abrasion. For this purpose it has long been known in the art that the surface of the pad should maintain a certain roughness not only for direct mechanical abrasive action at a desirable pace but also to provide certain spacing on the surface of the pad for transport of the slurry. If the surface of the pad becomes too smooth, these objectives are not met and the CMP process is not effective.

To overcome this problem, CMP processes employ a diamond conditioner disk that continually roughens the surface of the polishing pad to counteract the gradual flattening of the pad surface that occurs due to abrasion and plastic deformation from the slurry and wafer. This roughening or conditioning results both in the desired effect of continued effective mechanical abrasion of the wafer and gradual reduction of the polishing pad thickness. The ability of the conditioning disk to maintain roughness is clearly important because if the pad is not rough enough, mechanical abrasion will not occur at the desired pace. Moreover, the wearing away of the pad thickness is important because it eventually leads to the replacement of the pad.

Needless to say different processes have certain desirable degrees of roughness and other surface characteristics and acceptable rates of wear and these can be adjusted by the manner in which the pad is manufactured, the material it is manufactured from and the manner of its use.

One of the problems presently encountered in CMP processing is that to be economically effective the pad needs to be in use for long continuous periods of time. In present practice the pad is attached to the CMP polishing platen using a double-sided adhesive film and CMP processing is done for long periods of time. In general the characteristics of pad wear are known but as slurries and wafer characteristics and the materials that are polished are changed it can be expected that surface characteristics and wear rates can be affected. It is of considerable economic importance to gain an accurate understanding at the start or modification of each CMP process of specifically how the pad is going to wear, how rough it is going to be and how fast it is going to wear.

Presently the polishing pad in either a production or research environment is used for what is considered a suitable length of time (up to several tens of hours) and then stripped from the platen, a process that irreversibly deforms or damages the pad and its adhesive layer and usually precludes further use. A new pad is then installed, broken in with the conditioner, seasoned with slurry, and qualified for polishing product wafers. A pad changeover can require several hours of tool down time and loss of productivity. For some CMP work where conditions change after exhausting a relatively small amount of pad the loss in productivity can be significant. In addition to productivity loss, several kinds of surface measurements that could be useful for monitoring the condition of the pad during break-in and processing must be deferred until the pad is removed, or else a sample must be physically cut from the pad for such monitoring, a practice that often deforms the sample and always damages the pad. It is desirable that there be a process or device making it possible to easily and cost effectively perform measurements on the pad surface without having to irreversibly remove the pad or a sample of the pad, without having to wait for the end of the process and without engendering a significant amount of lost time or use of resources.

To date, no effective method has been disclosed by manufacturers for facilitating the taking of measurements of and exchange and storage of pads during operation and users have had to rely shutting the CMP process down and either removing the pad or a sample of the pad and measuring it, which is neither cost effective from the standpoint of time nor conducive to desired levels of quality control. Removal of the pad or a sample has meant distortion or irreversible damage of the pad surface and the pad making measurements of the pad surface of questionable use and validity and generally rendering the pad unusable thereafter. The alternative is to wait for the end of the process to conduct measurements, in which case wastage may have occurred during the initial run and which in any case will not provide information about wear during the initial stages of use of the pad. Even in this case it is generally true that pad removal will damage and put at risk any measurement data that might have been obtained.

Methods to solve this problem have included, for example, U.S. Pat. No. 6,422,921 which describes a method for detaching the CMP pad by means of the use of an adhesive t. However in the method taught the pad can be softened by heating it to the point where the platen will release the pad so that it can be removed.

However, this method, although it allows the pad to be removed more easily that before, is limited by the fact that considerable additional equipment is needed to make it possible, the fact that temperature and other conditions of CMP must be limited to avoid the risk of the CMP pad coming loose when it is not desired that it be removed and finally, this method does not solve the problem of deformation of the CMP pad surface when it is removed from the platen.

Moreover, U.S. Pat. No. 7,156,722 (filed Oct. 28, 2005) describes a removable platen that is affixed by a vacuum apparatus. However, although this application describes a method and apparatus where the platen can be removed intact, it is not clear that the vacuum supporting detachable part of the platen is easily suitable for introduction into large stage measuring devices, the vacuum must be created, maintained and released which add considerable additional complexity to the operation of this type of method and apparatus, conditions must be more carefully maintained to prevent material from entering areas that would create a problem for reestablishing the vacuum seal, the apparatus will clearly involve significant additional cost and once removed from the CMP apparatus, the pad must still be removed from the detachable portion of the platen before a new pad can be used.

Additionally, the XCEDA tool of Novellus Systems is a detachable upper surface on which the pad rests that can be removed and strictly speaking, allows the advantages of being able to remove a pad for metrology or storage and then later returning it to use for polishing. However, the pad and detachable upper surface are relatively high cost, the means of detachment, while it is not destructive of the pad is not particularly convenient, the pad is opaque which does not allow inspection of the lower side to determine if the pad is well seated with no bubbles or not and the system cannot be retrofitted to fit any tool or polisher.

Users of CMP Polishing Pads need to know that they are receiving the same quality of product from the polishing pad manufacturers from the standpoint of process effectiveness on a consistent basis and such a device or method would allow users to better determine specifications for what they require. Users also want to know, as stated above, how well their pads are faring under certain operating conditions and a method or device that will allow them to an accurately determine pad surface conditions and wear will provide them with useful information in that regard. Finally, from a research and development standpoint, the results of such a test would provide makers of CMP polishing pads with more useful information about how to improve existing manufacturing processes for CMP Polishing pads and provide better technical support to specific users and in the general development of new CMP and related processes.

As observed, above removable pad systems have been known in the prior art but they were not design for the purpose of providing secure and accurate replacement of the pad on the platen once it has been removed. The inventor of the present invention was unable to find in the prior art any method or device to suitably overcome this problem. More particularly, the inventor of the present invention was motivated by the fact that when pad samples were removed for optical interferometry, they were often visibly distorted after being cut and pried from the pad. This distortion had to be modeled and removed mathematically from the data. When subtle surface changes were likely to be present, samples cut and analyzed in this way were often of questionable value. The problem of how to accomplish a removable and replaceable pad for regular use on the CMP platen in a way that would maximize the ease and speed of removal, the integrity of the pad surface anticipating further use of the pad in CMP and the secure and essentially immobile condition of the two sheets with respect to each other, the platen and the pad once they were secured together were the object of sustained and focused investigation by the inventor of the present invention.

The present invention seeks to provide a useful device and an accurate and consistent method for allowing the simple, time saving and cost effective removal of CMP pads permitting the easy measurement and determination of surface characteristics of the CMP pad during use, exchange with other CMP pads and storage of used CMP pads with remaining useful life. These and other advantages of the invention will be apparent from the description of the invention provided herein.

BRIEF SUMMARY OF THE INVENTION

The invention provides a device for quick easy removal of the CMP polishing pad from the CMP polishing apparatus during brief periods during which polishing is suspended or stopped. More particularly the invention provides a device for quick, easy temporary and reversible removal of the CMP polishing pad from the platen of the CMP apparatus during brief periods during which polishing is suspended or stopped by attaching and detaching the polishing pad or pad substitute to and from the rotary polishing platen in a CMP polishing apparatus or equipment used for CMP without irreversibly damaging or distorting the pad which device consists of two circular or other suitably shaped sheets with precisely matching hole patterns where pins or other suitable protrusions have been placed to fit tightly or have been fastened securely into the holes in one of the two sheets, one sheet having a pad or pad substitute mounted by standard pad attachment methods to the surface opposite the surface containing the holes or alternatively the securely fastened pins or other protrusions and the other pad attached on the polisher platen with pins or other protrusions or holes, as the case may be facing upward, where the upper sheet is placed on the lower sheet so that the pins or other protrusions and holes mate and the lower surface of the upper sheet and the upper surface of the lower sheet are securely in contact so that CMP may be commenced.

The present invention also provides a method for quick easy removal of the CMP polishing pad from the CMP polishing apparatus during brief periods during which polishing is suspended or stopped. More particularly the invention provides a method for quick, easy temporary and reversible removal of the CMP polishing pad from the platen of the CMP apparatus during brief periods during which polishing is suspended or stopped by attaching and detaching the polishing pad or pad substitute to and from the rotary polishing platen in a CMP polishing apparatus or equipment used for CMP without irreversibly damaging or distorting the pad which device consists of two circular sheets with precisely matching hole patterns where pins or other suitable protrusions have been placed to fit tightly or have been fastened securely into the holes in one of the two sheets, one sheet having a pad or pad substitute mounted by standard pad attachment methods to the surface opposite the surface containing the holes or alternatively the securely fastened pins or other protrusions and the other pad attached on the polisher sheet with pins or other protrusions or holes, as the case may be facing upward, where the upper sheet is placed on the lower sheet so that the pins or other protrusions and holes mate and the lower surface of the upper sheet and the upper surface of the lower sheet are securely in contact so that CMP may be commenced.

The present invention more particularly provides a device and method as described above in which the pins or protrusions are shaped or and more particularly tapered at the end to obtain repeated, easy, precise placement and removal of the upper sheet on the lower. The pins need not be tapered or beveled and may be stepped or curved or shaped in any way that facilitates their easy removal, however tapering or beveling of the half that is not fixed to a sheet so that the diameter furthest from the sheet to which the pin or peg is fixed is smaller than the diameter at the mid point and fixed end of the pin or peg. The pegs may additionally be coated with a plastic or low friction substance to ease removal and attachment. Finally in the device of the present invention, a vacuum may be applied between the sheets to provide more secure conformation of the upper and lower sheets during CMP.

BRIEF DESCRIPTION OF THE SEVERAL VIEWS OF THE DRAWING(S)

FIG. 1 is an upper view of the separated upper sheet of the device of the present invention demonstrating the scale, placement and alignment of holes and pins or other protrusions or depressions in the upper sheet.

FIG. 2 is an upper view of the separated lower sheet of the device of the present invention demonstrating the scale, placement and alignment of holes and pins or other protrusions or depressions in the lower sheet.

FIG. 3 is a side cross sectional view of the two sheets apart.

FIG. 4 is a side view of the pin showing beveling or tapering.

DETAILED DESCRIPTION OF THE INVENTION

FIG. 1 is an upper view of the separated upper sheet of the device of the present invention demonstrating the scale, placement and alignment of holes and pins or other protrusions or depressions in the upper sheet.

10 is the upper plate 12 is the holes in the upper sheet

FIG. 2 is an upper view of the separated lower sheet of the device of the present invention demonstrating the scale, placement and alignment of holes and pins or other protrusions or depressions in the lower sheet.

20 is the lower plate 22 is the holes in the lower sheet occupied as the case may be by pins or pegs.

FIG. 3 is a side cross sectional view of the two sheets opened apart. Numbering is as in FIG. 1 and FIG. 2.

FIG. 4 is a side view of the pins showing tapering or beveling 30 is the beveled or tapered portion of the pin. Otherwise, numbering shall be as in FIGS. 1 and 2 above.

The inventor of the present invention has discovered and developed a device for quick easy removal of the CMP polishing pad from the CMP polishing apparatus during the periods during which polishing is suspended or stopped. More particularly the inventor of the present invention has discovered and developed a device that offers quick, easy, temporary reversible removal of the CMP polishing pad from the CMP polishing apparatus during brief periods during which polishing is suspended or stopped by attaching and detaching or exchanging the polishing pad or pad substitute to and from the rotary polishing platen in a CMP polishing apparatus or equipment used for CMP without irreversibly damaging or distorting the pad which device consists of two circular sheets with precisely matching hole patterns where pins or other suitable protrusions have been placed to fit tightly or have been fastened securely into the holes in one of the two sheets, one sheet has a pad or pad substitute mounted by standard pad attachment methods to the surface opposite the surface containing the holes or alternatively the securely fastened pins or other protrusions and the other pad is attached on the polisher platen with pins or other protrusions or holes, as the case may be facing upward, where the sheet is placed on the lower sheet so that the pins or other protrusions and holes mate and the lower surface of the upper sheet and the upper surface of the lower sheet are securely in contact so that CMP may be commenced.

More specifically, the inventor found that by preparing two polycarbonate sheets of thickness 1/32 inch or greater cut to the size and circular shape of the CMP platen and drilling five holes, one in the center and the other four in a square pattern centered on the first hole at a distance of about ½ to ¾ of the radial distance from the center, the holes about ¼ to ⅜ inch in diameter, or more specifically just enough larger than these dimensions to accommodate pegs of these same dimensions, in the holes of the bottom sheet metal pegs made of aluminum stainless steel or other suitable hard and corrosion-resistant alloy of the same diameter and length equal to the sum of the thickness of the two sheets optionally said length optionally machined to 0.1 or 0.2 mm less and said pegs machined so that the protruding part is beveled inward at an angle of one degree or so, said pegs affixed into the said lower sheet by water resistant adhesives. The top side of the top sheet is treated in a manner identical to the polishing platen and the CMP polishing pad is affixed thereto in the same manner as CMP polishing pads are normally affixed to the platen after which the upper sheet with the CMP polishing pad is placed on top of the lower sheet on the platen and CMP polishing is commenced.

The two polycarbonate sheets are preferably transparent polycarbonate sheets of between 1/32 inch and one-half inch in thickness.

The diameter of the sheets should be approximately the size and shape of the platen and approximately the same shape. Minor variation such as making the upper sheet slightly larger in diameter than the lower sheet for easier removal may be desirable at the election of the user. Though no specific lateral dimensions or shape are required, for the sheets of the present invention the sheets, and particularly the upper sheet, must be of sufficient dimensions in all directions to underlie the entire CMP polishing pad and must be of a shape that does not hinder the rotation of the platen or otherwise significantly interfere with CMP operations and any shape that meets these requirements will be suitable for the sheets of the present invention. Circular shape of both upper and lower plates is preferred.

The thickness of the sheets is not particularly limited provided that the sheets must be thick enough to provide adequate lateral support of the pegs or other protrusions and to maintain essentially complete structural integrity during CMP operations. They must not be so thick that taken together they raise the pad to a level above the platen where use of the CMP polishing device is impaired. Furthermore they should not be so thick that their weight or in particular the weight of the upper sheet CMP pad combination is so great as to interfere with normal CMP polishing apparatus operation or to make handling of the said sheet CMP pad combination difficult or dangerous either to operators or the pad. Thickness of the said sheets may vary slightly subject to the requirement that the surfaces facing the CMP polishing pad and the CMP polishing apparatus platen are flat, level and adequately supported, provided however that uniform thickness of the sheets is preferred. The thickness of the individual sheets need not be the same and may be varied according to considerations of the need to support the CMP polishing sheet and laterally support the pins, pegs or protrusions but absent special requirements, upper and lower sheets having the same thickness are preferred.

The material from which the sheets are composed is not particularly limited but a material that is hard, durable, shock resistant, vibration resistant, heat resistant to mild heat, water resistant and chemical resistant material, in which the density and weight are such that it is easily moveable by an operator is preferred. A material that is additionally easily machinable and able to maintain its form after machining and permit adhesion by hydrophobic adhesives is more preferred. Given as examples of materials that may be used are metals such as aluminum and plastics such as pure resin polymers or copolymers that are not water soluble or chemically reactive. The resins which may be used are not particularly limited but resins such as polycarbonates, certain polyamides, polyacrylic resins, polymethacrylate resins or polymethyl methacrylate resins are preferred and polycarbonate is more preferred.

The resins may be in pure unalloyed form or as polymer alloys or may be compounded with reinforcing fillers or contain other additives to enhance strength, chemical resistance or other properties. The said filler may include glass fiber, talc or any other commonly used fillers known to the art or any combination thereof. The lower and upper sheet may be made of either the same or different material but the identical composition of both sheets is preferred. Either the upper or the lower sheet or both sheets may be coated or surface treated on either one or both surfaces to enhance characteristics desirable for CMP processing. Such treatment may be general or it may be local such as the addition of materials for the purpose of strengthening the sheet at the point where it had been drilled to add the pegs or pins. The sheets may further be laminates of the same different materials or they may be uniformly made of one material and the latter is preferred. Further there is no limitation on whether the sheets are colored, colorless, transparent, translucent or opaque.

The holes in the said sheets of the present invention shall have dimensions large enough to accommodate pins or pegs sufficiently strong taking into account the number and positioning of pegs an pins used to support the sheets during operation of the CMP process and prevent their movement or change of position thereby. The dimensions of the holes shall be the same or slightly larger than the largest diameter of the pins or pegs to be used and these shall be preferably between ⅛ inch and ½ inch in diameter and more preferably between ¼ inch and ⅜ inch in diameter. The holes may be prepared by means of a mechanical drill or a laser or any other means suitable for making precision sized opening in sheets of this kind provided, however that the use of a drill is preferred. The holes may be all of the way through both sheets or they may be part way through either the bottom sheet and top sheet and all of the way through the other of part way through both sheets. In the event that a hole is only made partway through a sheet it must be deep enough to support the pins or pegs or protrusions later to be inserted and preferably at least ¼ inch.

Drilling holes all of the way through both sheets is preferred because this allows the bottom sheet to be used as a template for several top sheets each of which is holding a different CMP pad. Drilling the holes at the same time allows greater precision in the placement of the upper and lower holes and in consequence when this is done the two sheets should be clamped or otherwise tightly secured together.

The numbering and positioning of the holes is not particularly limited but it should be such that the pegs, when placed, adequately support the transfer of the CMP platen rotation to the CMP pad. Conversely too many holes potentially weakens the structure of the sheets, creates additional cleaning and maintenance problems, requires additional work in preparing the wholes and fitting and machining the pegs or pins, and may make removal of the upper sheet and CMP pad less facile. An optimum number of holes at a diameter of about ⅛ to ¼ inch for the pegs would be 4 to 8 holes. These holes may be positioned symmetrically with respect to the center of rotation or in a square grid pattern. A symmetrical positioning pattern for the holes involving a central hole placed on the axis of rotation of the platen and the remaining holes placed in positions of the angular vertices of a regular polygon one vertex for each hole and the distance of the holes from the said axis set at between ⅜ and ¾ of the radius of the lower sheet is preferred. Such a symmetrical hole positioning pattern comprising five holes, one hole at the axis of rotation in the center of the sheet and 4 holes in a square shape centered on the axis of rotation of the sheet with the outer holes set at a distance from the central hole of about ⅔ of the radius of the lower sheet is more preferred.

The holes in either the lower sheet or the upper sheet or partially in both sheets may contain permanently or temporarily affixed pegs or pins for the purposes of fixing the two sheets together during CMP operation. As a practical matter affixing the pegs to the lower sheet is preferred because when pins are attached to the upper sheet they can interfere with the placement of the pad on metrology tools. In any embodiment in which the pegs, pins or protrusions are in the upper sheet, the number must be sufficient to provide even support to the CMP polishing pad on top of it. This means the sheet should not sag and ideally the sheet should rest horizontally. However, if the pegs are all in the lower sheet this problem is avoided entirely. Further if the pegs are in the upper sheet it allows detritus and other material to collect in the holes in the lower sheet which will require cleaning in order for a precise fit to be obtained. This problem is far less serious where the pegs are in the lower sheet blocking accumulation of matter that could impede future usage. The pegs may be affixed to a sheet simply by placing them in the holes, though a fairly precise fit would be required in this case, or by placing them in the holes and causing them to adhere to the sheets by means of some adhesive compound or suitable cross linking agent. Further the pegs or pins may be placed in the sheet at the time the sheet is made by injection molding or press lamination in cases where the sheet is prepared specially for this application. This method may raise the cost but be desirable in that it removes the necessity of having the user prepare the sheets. Such pre-prepared sheets may also have embedded metal or ceramic sockets and these may be threaded or have some other catch suitable to the particular pins used. In this case it is preferable if the alternate, preferably the upper, sheet come with the holes ready made and precisely placed. If the base of the socket were wide the sockets would be better grounded in the sheet allowing greater stress to be born by individual pins. Also this would relieve the user of the task of having to place holes in the upper sheet against holes in the lower that are already partly filled by threaded sockets and in drilling damage the threads or the socket. Moreover, if the sheet that does not contain the pegs is pre-prepared in this way, it might also be convenient to include non-threaded sockets of metal or ceramic in this layer to receive the pins, pegs or protrusions. However, since the longevity of the upper sheets in particular is not expected to be so great compared to that of the lower sheet, this is not necessarily preferred to simply making holes.

The material to be used in the pins is not particularly limited and may be by way of example an engineering plastic, a ceramic or a metal but metals are preferred and aluminum or stainless steel pins or pegs are more preferred. Aluminum pins are most preferred. The surface of the pins is not particularly limited but a polished surface or otherwise very smooth surface is preferred. The length of the pins or pegs should be long enough to provide effective support to the upper sheet during CMP processing and in any case it is preferred if they are ¼ inch or longer. The pins may be no longer than the length of the hole. It is preferred that the end of the pin or peg that enters the open hole in the receiving sheet be lightly beveled and the angle for this beveling may be between 0.5 and 1 degree and preferably between one and two degrees. In the event that it is necessary to bevel straight pins or pegs this should be done by conventional grinding methods as carefully as possible followed by polishing of the ground surface to the degree feasible.

Instead of pins or pegs protrusions may be made either my injection molding or lamination processes to the same specifications as the holes in the receiving plate provided, however, that since such protrusions are part of one of the sheets and made of essentially the same or a similar material, they be somewhat wider in diameter than the aforesaid pins or pegs, preferably at least ⅜ inch in diameter and up to as much as one inch and diameter and they may be shallower. As a practical matter, such sheets should be molded or prepared by an enterprise skilled in such manufacture. The location of the protrusions can be either in the same or similar positions as the pins or pegs or can be along the outer rim of one or both sheets and should carefully be matched by a recess or hole prepared in the other sheet.

The method for using the sheets is not limited and is actually quite simple and straightforward. The lower sheet is attached to the platen in the same way as CMP pads or their bases are normally attached to CMP platens. The CMP polishing pad is attached to the upper surface of the upper sheet in the same way as CMP pads are normally attached to the platen and water, heat and chemical resistant adhesives or protective coatings can be used in the attachment process as desired. Then the upper sheet is lowered manually or mechanically onto the lower sheet so that the holes in one sheet line up with the corresponding pins, pegs or protrusions in the other sheet. After determining that the two sheets are securely in contact and the fit snug, CMP process may be commenced. Additional securing may be obtained by maintaining a small vacuum line into the lower plate as described in U.S. Pat. No. 7,156,722 or otherwise by connecting the vacuum line to the upper surface of the lower plate. Since the fit of the plates is close, the provisional vacuum thus created in the thin space between the plates will increase the stability of the bond between the sheets caused by the weight of the upper sheet assembly and the pegs, pins or protrusions. Other additional or alternative means of securing the sheets together may be considered insofar as they do not interfere with the CMP process or damage the CMP pad or sheets and are not so complicated or difficult as to render removal of the sheet difficult or time consuming.

When it is desired for any reason to remove the CMP polishing pad for storage or analysis, it may again be placed on the platen a CMP process may continue as before.

An additional element that increases the effectiveness of the present invention is to use a template with holes set in the desired place to make further upper and lower sheets. This allows users to continue making upper sheets using precisely the same plan even after the lower sheet has been affixed to the platen and is in use. It also allows partial holes to be drilled into both upper and lower sheets at the same time although this is not the preferred embodiment of the present invention. The template sheet need not be made of polycarbonate or other resin but may be made of any durable material that will maintain its edge so as to provide a precise guide for creating the holes.

EXAMPLES

The following practice example based on further illustrates the invention but, should not be construed as in any way limiting its scope.

Example 1

Two polycarbonate sheets (GE Plastics XL10 Lexan™) of thickness 3/32 inches were cut to the size of a platen for a CMP polishing device manufactured by Fujikoshi Machinery Corporation of 50 centimeters (20 inches) diameter to obtain an upper sheet and a lower sheet. The two sheets were aligned so that their edges were carefully matched, were clamped fast, and a drill with a bit diameter of ¼" was used to drill 5 holes cleanly through both sheets, a central hole and four outer holes in the shape of a square with the central hole at the center and having a distance to each hole from the center of 14.8 centimeters (5.82 inches). Aluminum pegs machined from aluminum stock and having a length of 0.18 inch were beveled from the midpoint to one of their ends. The extent of beveling obtained was a 1% angle from the vertical line of the original outer surface of the peg. One peg each was placed un-beveled into the hole using adhesive. The fit was checked by lowering upper sheet down on lower sheet and making such adjustments in the position and shaping of the pegs as were required.

After a perfect surface to surface fit was obtained between the two sheets, the lower sheet was affixed to the platen of a Fujikoshi Machinery Corporation CMP polishing device by a double sided adhesive sheet and a CMP polishing pad was carefully added to the top of the coated surface of the upper sheet and secured by means of a double sided adhesive sheet. Inspection was made for the presence of bubbles in the adhesive and when found these were removed by normal methods to obtain a relatively free adhesive layer. The upper sheet with the CMP polishing pad affixed was lowered carefully on to the lower sheet on the platen and CMP and they were further secured by the friction between the pins and the holes in the upper sheet. When secured preparation for CMP conditioning test was carried out and CMP conditioning was commenced and continued for several hours. At intervals, the CMP tool was stopped, excess liquid was removed from the vicinity of the CMP pad, the upper sheet and the lower sheet were released and the upper sheet with the CMP pad was removed by hand, carried to an optical interferometer and measured. After measurement was complete, the upper sheet with the CMP pad were returned to the CMP polishing device and placed on the lower sheet with the pegs and holes in the same positions they had been in before. Once the upper sheet with the CMP pad was secure, preparation and commencement of CMP conditioning were carried out as before. No damage was observed to the CMP pad and measurement data of good quality was easily obtained without having to terminate the use of the CMP polishing pad.

Example 2

Except that both the upper sheet and the lower sheet were prepared using a template determining the hole positions in the upper sheet and the CMP pad assembly and the lower sheet with pegs and were prepared and secured and CMP conditioning was performed under the same conditions as in example 1. Then using the template a second upper sheet and the CMP pad assembly was prepared under the same conditions as in example 1 except that no lower sheet was prepared. CMP processing was stopped, the first upper sheet and CMP pad assembly were removed and stored in a second place and were replaced by the second upper sheet and CMP pad assembly and CMP polishing was carried out. Then after several hours the second upper sheet and CMP pad assembly was removed according to the conditions of example 1 and the first upper sheet and CMP pad assembly restored and CMP conditioning was again carried out effectively and with no observable damage to the CMP pad of either assembly.

Example 3

Except that a vacuum hose was attached and used to secure the upper and lower sheets, an upper sheet and CMP pad assembly and a lower sheet with pegs 3 and 4 were prepared and secured and CMP polishing was performed under the same conditions as in example 1. CMP polishing was completed the vacuum released and the pad removed as in example 1.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

EFFECTS OF THE INVENTION

The present answer offers a solution to the problem of easy access to and mobility of the CMP polishing pad once the polishing process has started and offers the following significant advantages over the prior art. The CMP pads may be used removed stored and then reused at a later time. This substantially reduces the waste that would occur when the length of time needed for a particular process is significantly less than the useful pad life or when complex scheduling of experiments or jobs requires frequent changing of pads within a short time. Since pads are expensive highly specialized products the savings to research and manufacture can be considerable. If the same type of removal operation is attempted without the present invention there is the high probability, indeed even the near certainty the pad will be damaged by the removal to the extent that it significantly alters and impairs performance thereafter.

Moreover, along the same lines, in the event of complex scheduling of experiments or production over a period of time on a single polisher or limited numbers of polishers, the present invention permits far more flexible scheduling both by reducing waste as above and by reducing the time and effort needed to remove and replace the CMP pads. Moreover, if the lower pads of the present invention are identically made, for instance by use of a template, the upper pads may even be switched between polishers quite easily.

As stated earlier, a major benefit of the present invention is that by this method of removal metrology both after and during a polishing operation may be far more easily and effectively conducted. Heretofore interferometry has largely been almost entirely by removal of a small sample from the pad surface as it sits on the platen in the polishing device under current metrology and tool limitations. This process even if performed only once on a pad results in significant deformation of the pad and disruption of the process and potential invalidation of subsequent results.

If the upper sheet is transparent, for example by it having been made from a polycarbonate sheet, it is possible to inspect the adhesive layer of between the sheet and the CMP pad for bubbles and to determine whether the pad is securely attached to the sheet. The presence of bubbles or foam in the adhesive exert a mechanical effect on CMP pad polishing and alter the performance of the pad. The visibility of the adhesive layer through the upper sheet can be performed as the CMP pad is being attached and the presence of such bubbles or foam can be controlled and reduced.

Because the two sheets do not need to possess exactly the same lateral dimensions it is easy to retrofit the system to any older polishing device.

Finally, the materials used in the preferred embodiments of the present invention are inexpensive, easy to use and durable under CMP conditions.

In summary, the present invention strictly maintains the stringent conditions required for CMP polishing processes and at time very cost effectively makes possible a number of varied but important processes that were either not easily accomplished or impossible under the prior art.

What is claimed is:

1. A device for rendering CMP polishing pads easily and temporarily removable from and replaceable upon a platen of a CMP polishing apparatus, said device comprising two sheets consisting of an upper sheet attached to the said CMP polishing pad and a lower sheet attached to the said platen, the said two sheets being held together by pegs, pins or protrusions fitted to matching holes in an upper surface of the lower sheet and in a lower surface of the upper sheet, wherein said pegs or pins are attached to one of the upper and the lower sheet and are inserted in the holes of the either sheet, but in no event are the pegs, pins or protrusions inserted so far that the pegs, pins or protrusions protrude above or are even with the upper surface of the upper sheet, when the sheets are brought together, to hold the sheets together by means of sliding friction attendant upon a tight fit with the said holes.

2. A device for rendering CMP polishing pads easily and temporarily removable from and replaceable upon the platen of a CMP polishing apparatus according to claim 1 wherein the two sheets are in shape and horizontal dimensions the same as the CMP pad or the platen respectively.

3. A device for rendering CMP polishing pads easily and temporarily removable from and replaceable upon the platen of a CMP polishing apparatus according to claim 1 wherein the sheets are composed of a hard sheet polymer sheet material.

4. A device for rendering CMP polishing pads easily and temporarily removable from and replaceable upon the platen of a CMP polishing apparatus according to claim 1 wherein at least the upper sheet is made from transparent polyacrylate resin or polycarbonate resin.

5. A device for rendering CMP polishing pads easily and temporarily removable from and replaceable upon the platen of a CMP polishing apparatus according to claim 1 where the number of said holes is between 4 and 25.

6. A device for rendering CMP polishing pads easily and temporarily removable from and replaceable upon the platen of a CMP polishing apparatus according to claim 5 where the number of said holes is between 5 and 17.

7. A device for rendering CMP polishing pads easily and temporarily removable from and replaceable upon the platen of a CMP polishing apparatus according to claim 6 where the number of said holes is 5.

8. A device for rendering CMP polishing pads easily and temporarily removable from and replaceable upon the platen of a CMP polishing apparatus according to claim 6 where the number of said holes is 17.

9. A device for rendering CMP polishing pads easily and temporarily removable from and replaceable upon the platen of a CMP polishing apparatus according to claim 1 wherein the pegs or pins the said holes are made of a material resistant to corrosion and wear in CMP type environment.

10. A device for rendering CMP polishing pads easily and temporarily removable from and replaceable upon the platen of a CMP polishing apparatus according to claim 9 wherein the material resistant to corrosion and wear in CMP type environments is one member selected from the group consisting of stainless steel, polycarbonate resin and aluminum.

11. A device for rendering CMP polishing pads easily and temporarily removable from and replaceable upon the platen of a CMP polishing apparatus according to claim 9 wherein the material resistant to corrosion and wear in CMP type environments is aluminum.

12. A device for rendering CMP polishing pads easily and temporarily removable from and replaceable upon the platen of a CMP polishing apparatus according to claim 9 wherein the pegs or pins and the said holes possess dimensions equal to the thickness of the combined sheets and the diameter is between ⅛ inch and ⅜ inch.

13. A device for rendering CMP polishing pads easily and temporarily removable from and replaceable upon the platen of a CMP polishing apparatus according to claim 2 wherein the pegs, pins or protrusions are made of a polymer material and prepared by injection molding methods or lamination methods.

14. A device for rendering CMP polishing pads easily and temporarily removable from and replaceable upon the platen of a CMP polishing apparatus according to claim 13 wherein the said protrusions and the said holes possess dimensions equal to between ⅜ inch and ½ inch in height and the diameter or longest lateral dimension is between ⅛ inch and 1 inch.

15. A device for rendering CMP polishing pads easily and temporarily removable from and replaceable upon the platen of a CMP polishing apparatus according to claim 1 wherein the pegs or pins are tapered from just beyond the point where they emerge from the sheet to which they are attached.

16. A device for rendering CMP polishing pads easily and temporarily removable from and replaceable upon the platen of a CMP polishing apparatus according to claim 15 wherein said tapering is on the order of and angle of between 0.5 degrees to 5 degrees from an axial surface of the pegs or pins.

17. A device for rendering CMP polishing pads easily and temporarily removable from and replaceable upon the platen of a CMP polishing apparatus according to claim 16 wherein said tapering is on the order of an angle of between 1 degrees to 2 degrees from the axial surface of the pegs or pins.

18. A device for rendering CMP polishing pads easily and temporarily removable from and replaceable upon the platen of a CMP polishing apparatus according to claim 1 wherein in addition to the holding of the two sheets together by the holes and pegs a vacuum system and conduit are provided to the opposing surfaces of the two sheets through the platen and the lower sheet.

19. A device for rendering CMP polishing pads easily and temporarily removable from and replaceable upon the platen of a CMP polishing apparatus according to claim 1 wherein the holes are made through both secured sheets at the same time to obtain precise alignment of the holes.

20. A device for rendering CMP polishing pads easily and temporarily removable from and replaceable upon the platen of a CMP polishing apparatus according to claim 19 wherein a template is used to place the holes and wherein the same template can be used to prepare further upper or lower sheets in precisely the same pattern.

21. A device for rendering CMP polishing pads easily and temporarily removable from and replaceable upon the platen of a CMP polishing apparatus according to claim 1 wherein two transparent polycarbonate sheets of between 1/32 inch and ¼ inch thickness were cut to the shape respectively of a CMP polishing apparatus platen for the lower sheet and said the CMP polishing pad for the upper sheet and into these sheets 5 holes were drilled all the way through both sheets, each hole having a diameter of ¼ inch in a pattern whereby one hole was made in the center and the other four were arranged around the center in the shape of a square with the distance between the center hole and the outer holes being ⅔ of the radius of the CMP polishing pad and upper sheet, and where the holes of the lower sheet are fitted with aluminum pegs having dimensions corresponding to the thickness of the two sheets for length and the diameter of the holes for thickness with tapering starting between 1/32 inch and ⅛ inch past the point where the peg emerges from the lower sheet and where the angle of the tapering is on the order of and angle of between 1 degrees to 2 degrees from the axial surface of the pegs or pins, the said upper sheet being fixed by adhesive to a CMP polishing pad, the lower sheet being fixed to the platen of the CMP polishing apparatus and the said upper sheet and CMP polishing pad assembly being lowered so that the holes in lower surface of the upper sheet align with the pegs protruding from the lower sheet and the upper and lower sheet are allowed to come into tight contact.

22. A device for rendering CMP polishing pads easily and temporarily removable from and replaceable upon the platen of a CMP polishing apparatus according to claim 1 wherein two polycarbonate sheets of thickness 1/32 inch or greater cut to the size and circular shape of a CMP platen, five holes are made therein, one in the center and the other four in a square pattern centered on the first hole at a distance of about ½ to % of the radial distance from the center, the holes about ¼ to ⅜ inch in diameter, or more specifically just enough larger than these dimensions to accommodate pegs of these same dimensions, in the holes of the bottom sheet, metal pegs made of aluminum, stainless steel or other suitable hard and corrosion-resistant alloy of the same diameter and length as to the sum of the thickness of the two sheets said length is machined or prepared to 0.1 or 0.2 mm less and said pegs further machined or prepared so that the part protruding from the lower sheet is beveled inward from the center to the end at an angle of one degree or so, the said pegs affixed into the said lower sheet by water resistant adhesives and the upper side of the top sheet treated in a manner identical to or equivalent to the treatment of the polishing platen, the CMP polishing pad being then affixed thereto in the same manner as CMP polishing pads are normally affixed to CMP platen.

23. A method for rendering CMP polishing pads easily and temporarily removable from and replaceable upon a platen of a CMP polishing apparatus, by means of a device comprising two sheets consisting of an upper sheet attached to the said CMP polishing pad and a lower sheet attached to the said platen, the said two sheets being held together by pegs, pins or protrusions fitted to matching holes in an upper surface of the lower sheet and in a lower surface of the upper sheet, wherein said pegs or pins are attached to one of the upper and the lower sheet and are inserted in the holes of the either sheet, when the sheets are brought together, to hold the sheets together by means of sliding friction attendant upon a tight fit with the said holes.

* * * * *